US009461425B2

(12) United States Patent
Tamaki

(10) Patent No.: US 9,461,425 B2
(45) Date of Patent: Oct. 4, 2016

(54) CONNECTOR WITH EASILY POSITIONABLE PARTS

(71) Applicant: HOSIDEN CORPORATION, Osaka (JP)

(72) Inventor: Fumitake Tamaki, Osaka (JP)

(73) Assignee: HOSIDEN CORPORATION, Osaka (JP)

( * ) Notice: Subject to any disclaimer, the term of this patent is extended or adjusted under 35 U.S.C. 154(b) by 0 days.

(21) Appl. No.: 14/802,245

(22) Filed: Jul. 17, 2015

(65) Prior Publication Data

US 2016/0064877 A1 Mar. 3, 2016

(30) Foreign Application Priority Data

Aug. 28, 2014 (JP) ..... 2014-174304

(51) Int. Cl.

| | |
|---|---|
| ***H01R 13/648*** | (2006.01) |
| ***H01R 24/60*** | (2011.01) |
| ***H01R 13/508*** | (2006.01) |
| *H01R 13/6593* | (2011.01) |
| *H01R 107/00* | (2006.01) |

(52) U.S. Cl.

CPC ..... *H01R 24/60* (2013.01); *H01R 13/508* (2013.01); *H01R 13/6593* (2013.01); *H01R 2107/00* (2013.01)

(58) Field of Classification Search

CPC ..... H01R 13/65802; H01R 4/646; H01R 23/688; H01R 13/658; H01R 23/7073; H01R 13/514

USPC ..... 439/95, 98, 108, 607.05, 607.08, 439/607.28, 607.41, 607.51, 607.58, 660, 439/701

See application file for complete search history.

(56) References Cited

U.S. PATENT DOCUMENTS

| | | | | |
|---|---|---|---|---|
| 6,402,554 | B1 * | 6/2002 | Yeh | H01R 13/6594 439/607.39 |
| 7,811,131 | B2 * | 10/2010 | Wang | H01R 13/65802 439/607.35 |
| 8,011,969 | B2 * | 9/2011 | Wang | H01R 13/65802 439/607.35 |
| 8,038,480 | B2 * | 10/2011 | Wei | H01R 13/502 439/607.1 |
| 8,684,769 | B2 * | 4/2014 | Kao | H01R 13/6471 439/607.28 |
| 8,801,469 | B2 * | 8/2014 | Wu | H01R 13/6477 439/607.01 |
| 8,961,235 | B2 * | 2/2015 | Little | H01R 13/64 439/374 |

(Continued)

FOREIGN PATENT DOCUMENTS

| | | |
|---|---|---|
| CN | 201797116 | 4/2011 |
| JP | 2010-073549 | 4/2010 |
| TW | M480792 | 6/2014 |
| TW | M484832 | 8/2014 |

OTHER PUBLICATIONS

Search Report issued by E.P.O. patent office in E.P.O. Patent Application No. 15181372.2, dated Jan. 14, 2016.

*Primary Examiner* — Thanh Tam Le

(57) ABSTRACT

A connector which includes a metal piece, a contact assembly including a body which fixes a plurality of contacts, and a housing in which the contact assembly is inserted, in which the metal piece includes an arm portion which is extended in an arrangement direction of the contacts, an L-shaped portion, and of which an end surface is brought into contact only with a lateral wall of a concave portion of the housing, and a pressing portion which is formed by extending an end surface of the L-shaped portion, and which protrudes from a hole to be brought into contact only with a lateral wall of a recess of the body.

8 Claims, 10 Drawing Sheets

(56) References Cited

U.S. PATENT DOCUMENTS

| | | | | |
|---|---|---|---|---|
| 9,022,800 | B2 * | 5/2015 | Yang | H01R 13/6581 439/487 |
| 9,214,767 | B1 * | 12/2015 | Yu | H01R 13/6585 |
| 2010/0232118 | A1 | 9/2010 | Tochi et al. | |
| 2014/0073190 | A1 | 3/2014 | Zhao et al. | |
| 2015/0207281 | A1 | 7/2015 | Chien et al. | |
| 2015/0311645 | A1 | 10/2015 | Chang | |

* cited by examiner

CONNECTOR WITH EASILY POSITIONABLE PARTS

TECHNICAL FIELD

The present invention relates to a connector.

BACKGROUND ART

As the configuration of a connector of prior art and the configuration around a contact of the connector, those in Japanese Patent Application Laid Open No. 2010-073549, for example, are known.

In a case of a small connector, positioning of parts which constitute a connector is sometimes difficult. For example, in a case where the spring structure is used for fixing of resin-molded parts, small parts or thin portions of a part are sometimes damaged due to stress of the spring.

On the other hand, when parts which are stressed are formed large to some extent so as to avoid damage or breaking, reduction of a size of a connector is sometimes prevented.

SUMMARY OF THE INVENTION

Therefore, an object of the present invention is to provide a connector which enables positioning of parts constituting the connector while preventing damage of the parts even though the parts are small and thin.

A connector according to the present invention includes a metal piece, a contact assembly including a body which fixes a plurality of contacts, and a housing in which the contact assembly is inserted in a connector inserting direction to be accommodated.

The housing includes a concave portion which has a lateral wall which is opposed to a connector pulling-out direction, and a hole which is formed on a bottom surface of the concave portion.

The body includes a recess which has a lateral wall which is opposed to the connector inserting direction.

The metal piece includes an arm portion which is extended in an arrangement direction of the contacts, an L-shaped portion which is formed in a manner to be bent in a direction orthogonal to both of an extending direction of the arm portion and the connector inserting direction, and of which an end surface, in the connector pulling-out direction, is brought into contact only with the lateral wall of the concave portion of the housing in a case of connection with the housing, and a pressing portion which is formed by extending an end surface, in the connector inserting direction, of the L-shaped portion in a forward direction or an inverse direction of the extending direction of the arm portion, and which protrudes from the hole to be brought into contact only with the lateral wall of the recess of the body in a case of connection with the housing and the body.

According to the connector of the present invention, positioning of parts constituting the connector can be performed while preventing damage of the parts even though the parts are small and thin.

DETAILED DESCRIPTION OF THE EMBODIMENTS

Figure 1:
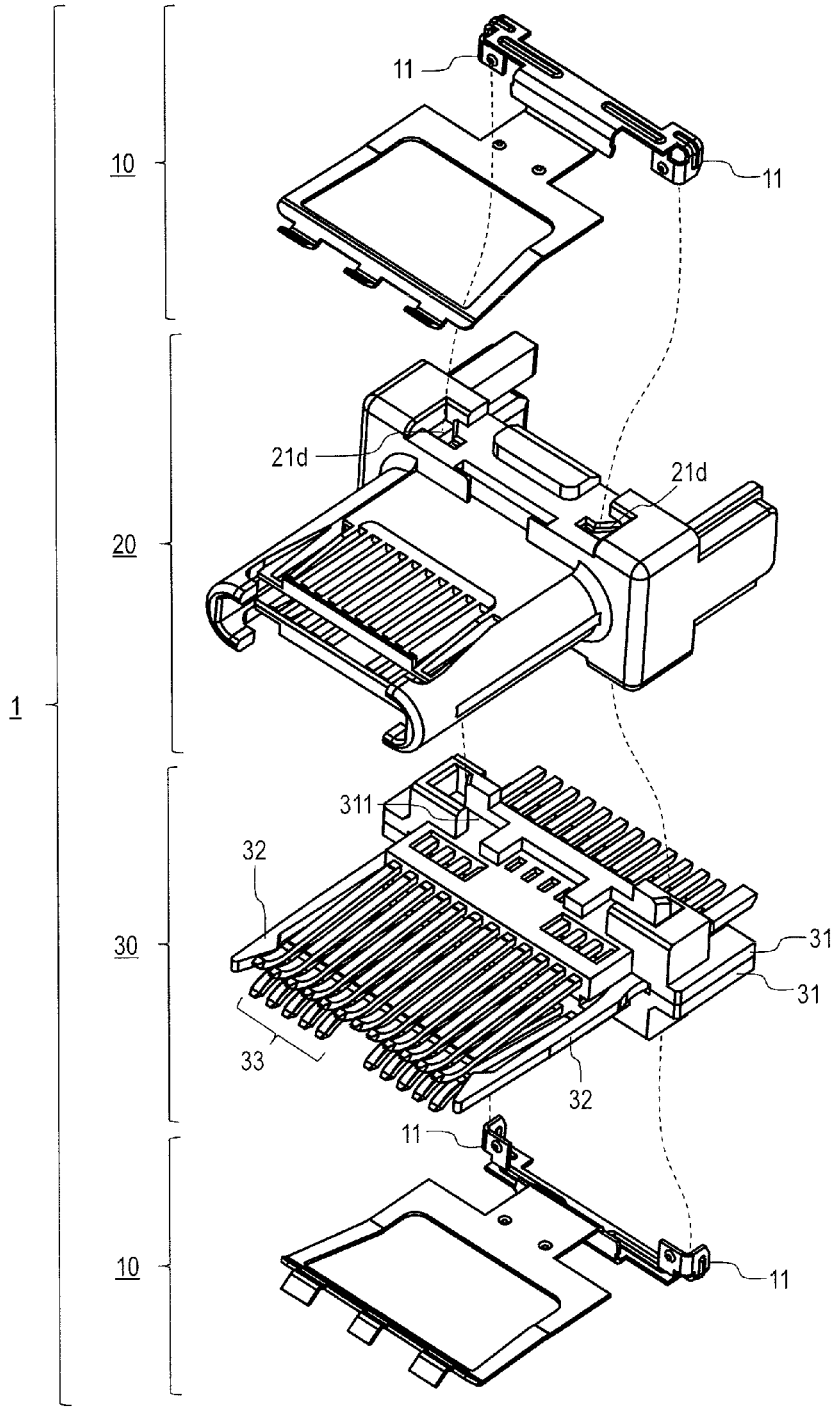
FIG. 1 is an exploded perspective view of a connector according to a first embodiment.

An embodiment of the present invention is described in detail below. Here, constituent parts having identical functions to each other are given identical reference characters and duplicate description of the parts is omitted.

First Embodiment

Each constituent part of a connector according to the first embodiment is described below with reference to FIG. 1. FIG. 1 is an exploded perspective view of a connector 1 according to the present embodiment. As illustrated in FIG. 1, the connector 1 of the present embodiment is composed of a pair of upper and lower metal pieces 10, a housing 20, and a contact assembly 30. The contact assembly 30 is an assembly which is formed by combining a plurality of contacts 33 forming a pair of upper and lower arrays, a pair of upper and lower bodies 31 which respectively fix the pair of upper and lower contact arrays, and a pair of left and right spring pieces 32 which are fixed in a manner to be sandwiched by the pair of upper and lower bodies 31 with each other. The upper and lower bodies 31 which make a pair are connected with each other in such a manner that bottom surfaces thereof face each other. The pair of left and right spring pieces 32 is fixed in a manner to be sandwiched by the bottom surfaces of the upper and lower bodies 31. The spring pieces 32 functions to hold a connector which is a fitting counterpart. On upper surfaces (another surfaces of the bottom surfaces which face each other) of the bodies 31, a recess 311 is formed. The housing 20 is a casing which has an opening in a connector pulling-out direction. From the opening of the housing 20, the contact assembly 30 can be inserted in a connector inserting direction. A pair of left and right holes 21*d* is formed on each of the upper surface and the lower surface of the housing 20. The recess 311 and the hole 21*d* are formed to have such shapes that a part of the recess 311 and the hole 21*d* are fitted to each other when the contact assembly 30 is accommodated in the housing 20. The metal piece 10 has arm portions 11 which are extended in an arrangement direction of the contacts 33. The arm portions 11 are formed such that the arm portions 11 are inserted from the upper surface side (and the lower surface side) of the housing 20 into the holes 21*d* to be fitted in the holes 21*d*. In this case, the arm portions 11 protrude toward an inner cavity of the housing 20 from the holes 21*d* to be fitted in a part of a shape of the recess 311. The arm portions 11 are thus fitted in both of the holes 21*d* and a part of the shape of the recess 311. Therefore, a pair of metal pieces 10, the housing 20, and the contact assembly 30 can be positioned on each other, and these parts can be connected and fixed to each other. Here, the metal pieces 10 are brought into contact with a shield cover which is not illustrated in the drawing.

Figure 2:
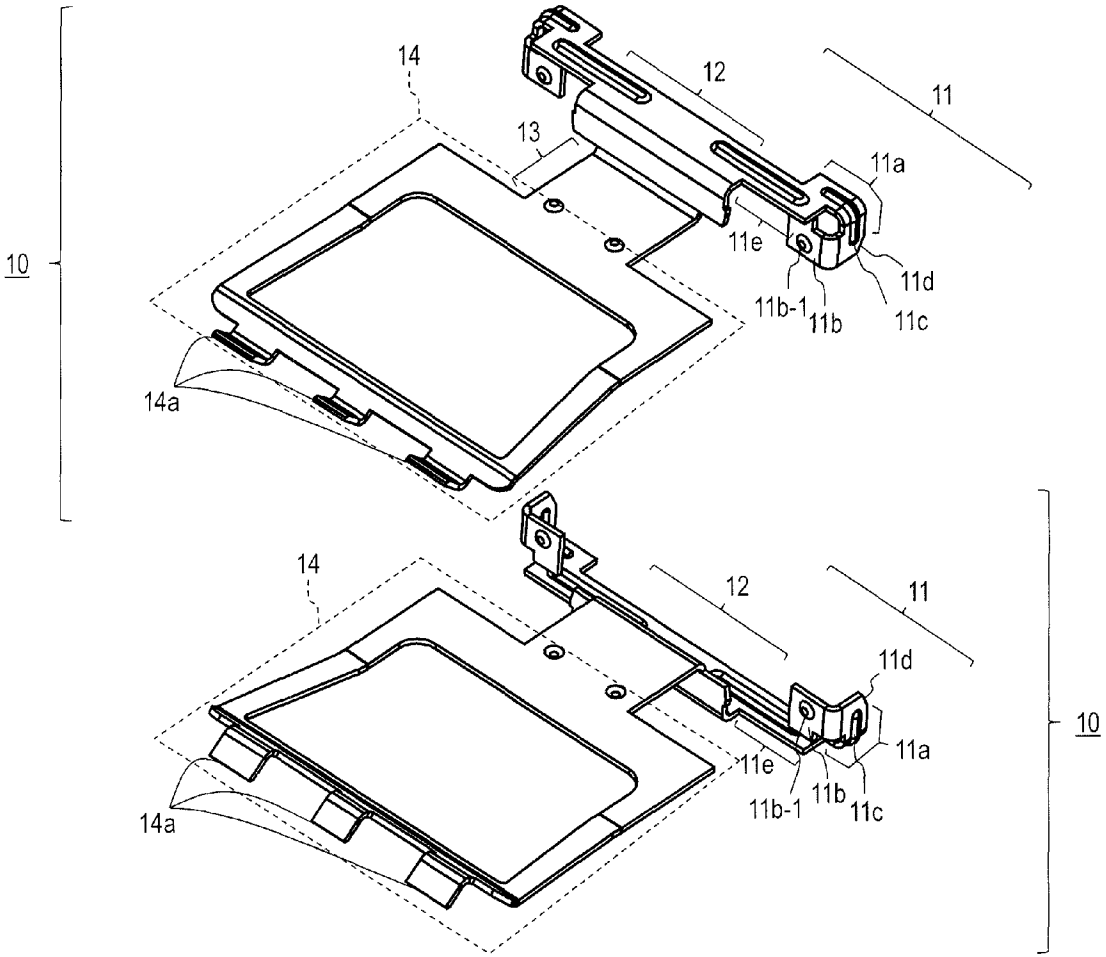
FIG. 2 is a perspective view of a pair of upper and lower metal pieces according to the first embodiment.

The configuration of the metal piece 10 is described in detail below with reference to FIG. 2. FIG. 2 is a perspective view of a pair of upper and lower metal pieces 10 according to the present embodiment. In the following description, only the upper metal piece 10 in a pair of upper and lower metal pieces 10 is focused and described. The lower metal piece 10 is obtained by merely disposing the upper metal piece 10 in such a manner that front and back surfaces of the upper metal piece 10 are reversed, and the lower metal piece 10 has a shape identical to that of the upper metal piece 10. As illustrated in FIG. 2, the metal piece 10 is provided with a contact portion 14 which is brought into contact with a metal piece of a counterpart connector in coupling with the counterpart connector. The contact portion 14 has an approximate frame shape and on an end of the contact portion 14 in a connector inserting direction, three pieces of contact pieces 14*a* are arranged. Here, the connector 1 of the present embodiment is designed in accordance with a standard of USB-Type C, and shapes of six pieces, in total, of contact pieces 14*a* of the upper and lower metal pieces 10 are an essential shape for USB-Type C. An end portion, in the connector pulling-out direction, of the contact portion 14 is extended in the connector pulling-out direction so as to form a coupling portion 13. To the connector pulling-out direction of the coupling portion 13, a support portion 12 which has a substantially L-shaped section is connected. The support portion 12 is composed of a lateral surface which vertically erects in an upward direction from the coupling portion 13 and an upper surface which is formed by bending the lateral surface in a horizontal direction. The upper surface of the support portion 12 is connected with the arm portions 11. The arm portion 11 represents a portion including an L-shaped portion 11*a*, a pressing portion 11*b*, a dowel 11*b*-1, a convex portion 11*c*, a notch 11*d*, and a protruding portion 11*e*. The upper surface of the support portion 12 is extended in a left and right direction (an arrangement direction of the contacts 33) of the metal piece 10 so as to form the protruding portion 11*e*. An end of the protruding portion 11*e* is bent to a downward direction so as to form the L-shaped portion 11*a*. Not limited to this, the L-shaped portion 11*a* may be formed by bending the end of the protruding portion 11*e* to an upward direction. Thus, the L-shaped portion 11*a* is formed by bending the end of the protruding portion 11*e* to either the downward direction or the upward direction (either one of two directions which are orthogonal to both of the extending direction of the protruding portion 11*e* and the connector inserting direction). On an upper surface and a lateral surface of the L-shaped portion 11*a*, a line of convex portion 11*c* which has a substantially semicircular section is formed. The notch 11*d* is formed on a part on the lower side of an end surface, in the connector pulling-out direction, of the L-shaped portion 11*a*. An end surface, in the connector inserting direction, of the L-shaped portion 11*a* is bent and extended in an opposite direction of the extending direction of the protruding portion 11*e* so as to form the pressing portion 11*b*. Not limited to this, the pressing portion 11*b* may be formed by bending and extending the end surface of the L-shaped portion 11*a* in the forward direction of the extending direction of the protruding portion 11*e*. The pressing portion 11*b* is coupled with the L-shaped portion 11*a* only on a bending part, so that some deflection is permitted in the connector inserting/pulling-out direction. That is, the pressing portion 11*b* serves as a spring piece which elastically deforms to a small extent in the connector inserting/pulling-out direction. Near the center of a surface, which is opposed to the connector pulling-out direction, of the pressing portion 11*b*, the dowel 11*b*-1 is formed.

Figure 3:
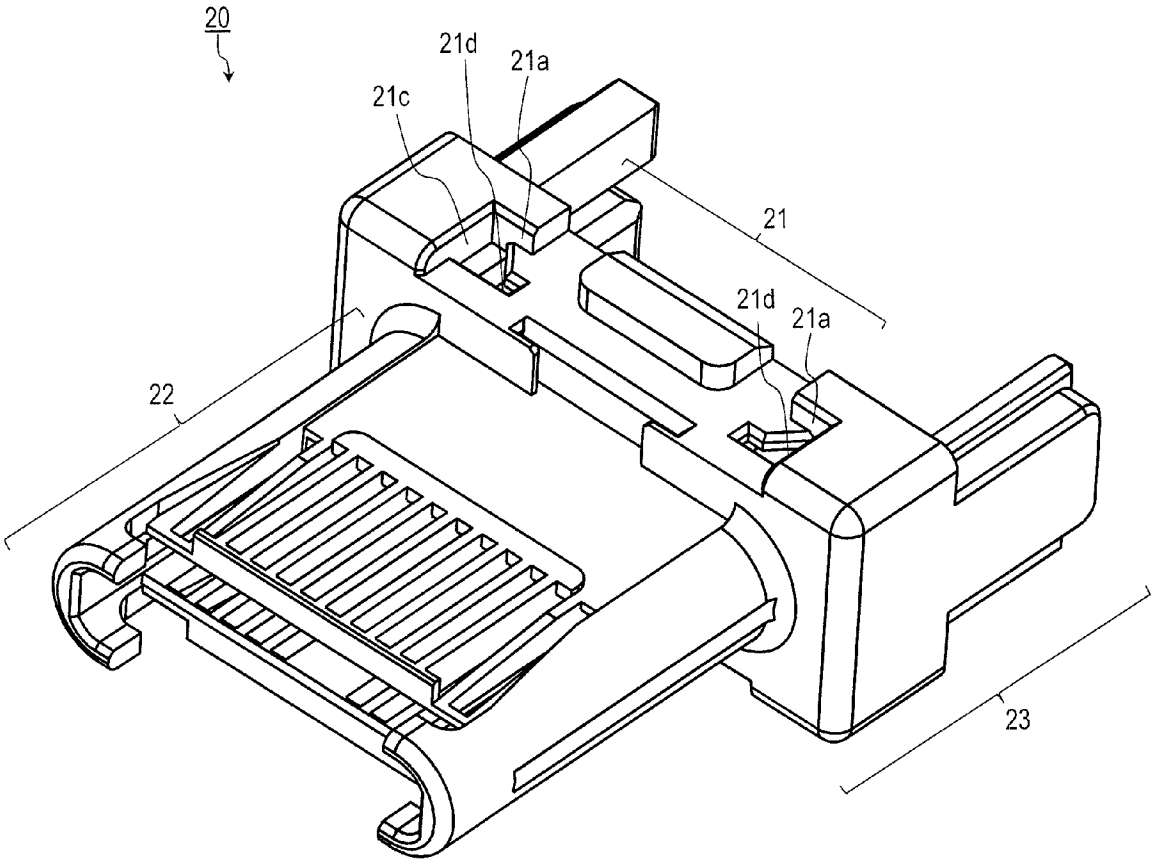
FIG. 3 is a perspective view of a housing according to the first embodiment.

Subsequently, the configuration of the housing 20 is described in detail with reference to FIG. 3. FIG. 3 is a perspective view of the housing 20 according to the present embodiment. As illustrated in FIG. 3, the housing 20 is composed of a protruding portion 22 which accommodates end portions of the contacts 33 and a base portion 23 which accommodates the bodies 31. Each of the protruding portion 22 and the base portion 23 of the housing 20 has the same configurations on an upper surface and a lower surface. On the upper surface and the lower surface of the base portion 23, concave portions 21 are respectively formed. On both left and right ends of a pair of upper and lower concave portions 21, first lateral walls 21*a* which are opposed to the connector pulling-out direction and third lateral walls 21*c* which are opposed to the extending direction of the arm portions 11 which are described above are formed. A pair of left and right holes 21*d* is formed on bottom surfaces of the pair of upper and lower concave portions 21. The hole 21*d* is formed in a region sandwiched (surrounded) by the first lateral wall 21*a* and the third lateral wall 21*c*. The hole 21*d* is formed in a shape and a dimension which permit insertion of the lower end portion of the L-shaped portion 11*a* described above and the pressing portion 11*b* described above.

Figure 4:
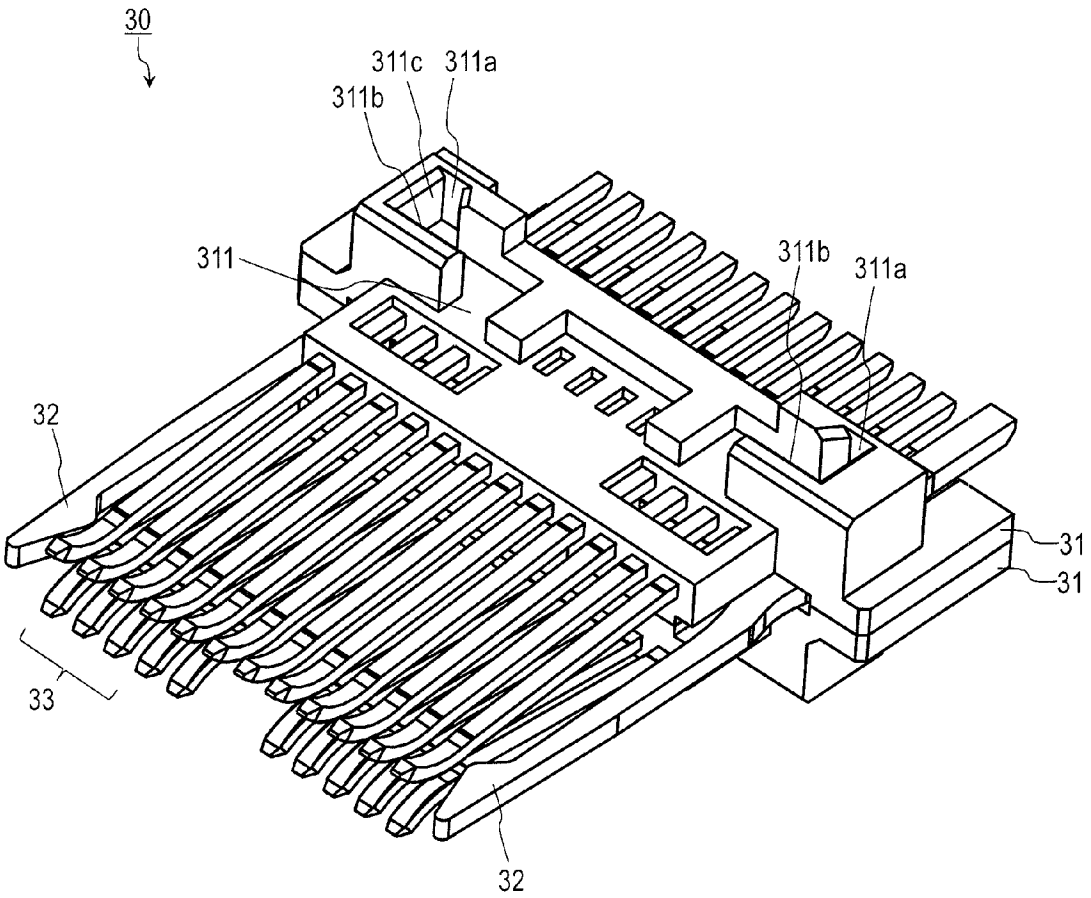
FIG. 4 is a perspective view of a contact assembly according to the first embodiment.

Next, the configuration of the body 31 is described in detail with reference to FIG. 4. FIG. 4 is a perspective view of the contact assembly 30 according to the present embodiment. As mentioned above, the contact assembly 30 is an assembly which is formed by combining a plurality of contacts 33 forming a pair of upper and lower arrays, a pair of upper and lower bodies 31, and a pair of left and right spring pieces 32 with each other. Only the upper body 31 in a pair of upper and lower bodies 31 is focused and described below. The lower body 31 is obtained by merely disposing the upper body 31 in such a manner that front and back surfaces of the upper body 31 are reversed, and the lower body 31 has a shape identical to that of the upper body 31. On the upper surface of the body 31, the recess 311 is formed. On both of left and right ends of the recess 311, first lateral walls 311*a* which are opposed to the connector pulling-out direction, second lateral walls 311*b* which are opposed to the connector inserting direction, and third lateral walls 311*c* which are opposed to the extending direction of the arm portions 11 described above are formed.

Figure 5:
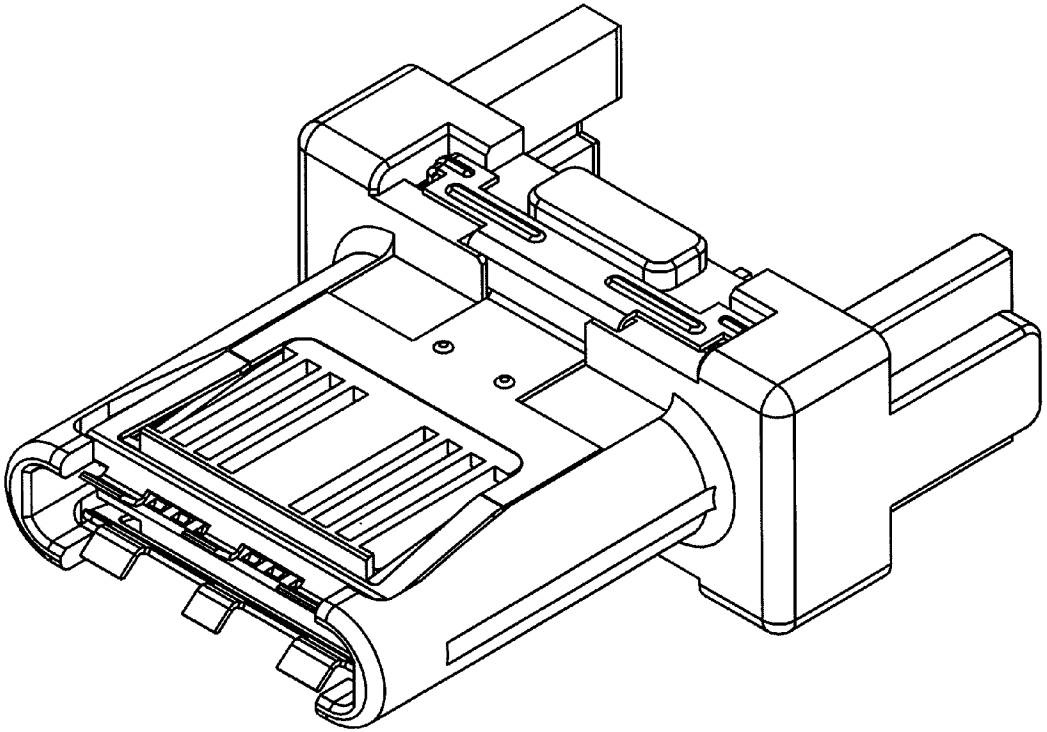
FIG. 5 is a perspective view of the connector according to the first embodiment.
Figure 6:
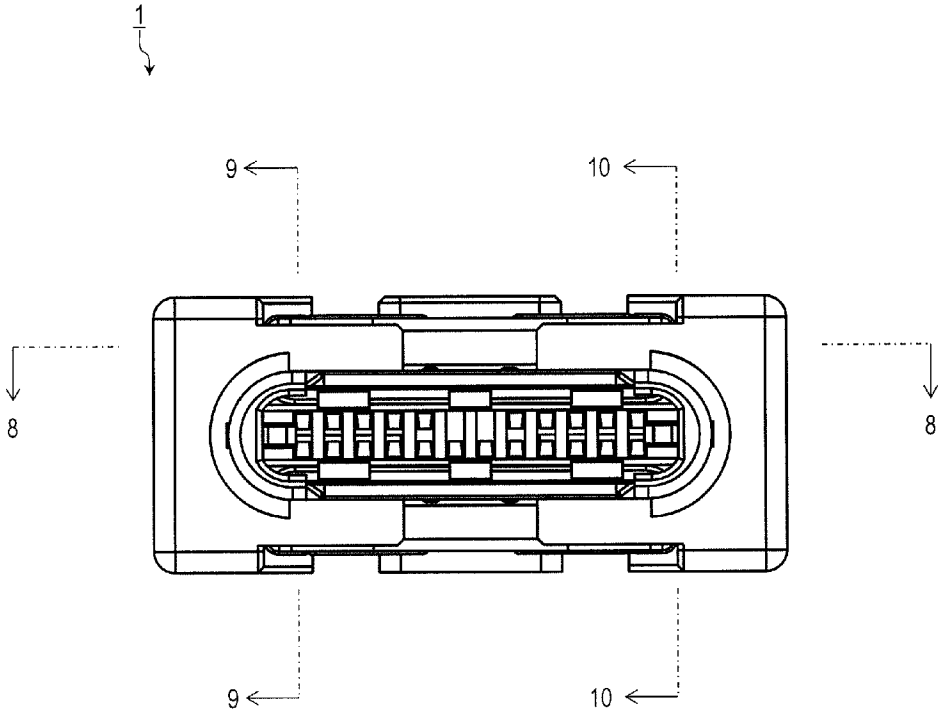
FIG. 6 is a front elevational view including indicating lines of sections of the connector according to the first embodiment.
Figure 7:
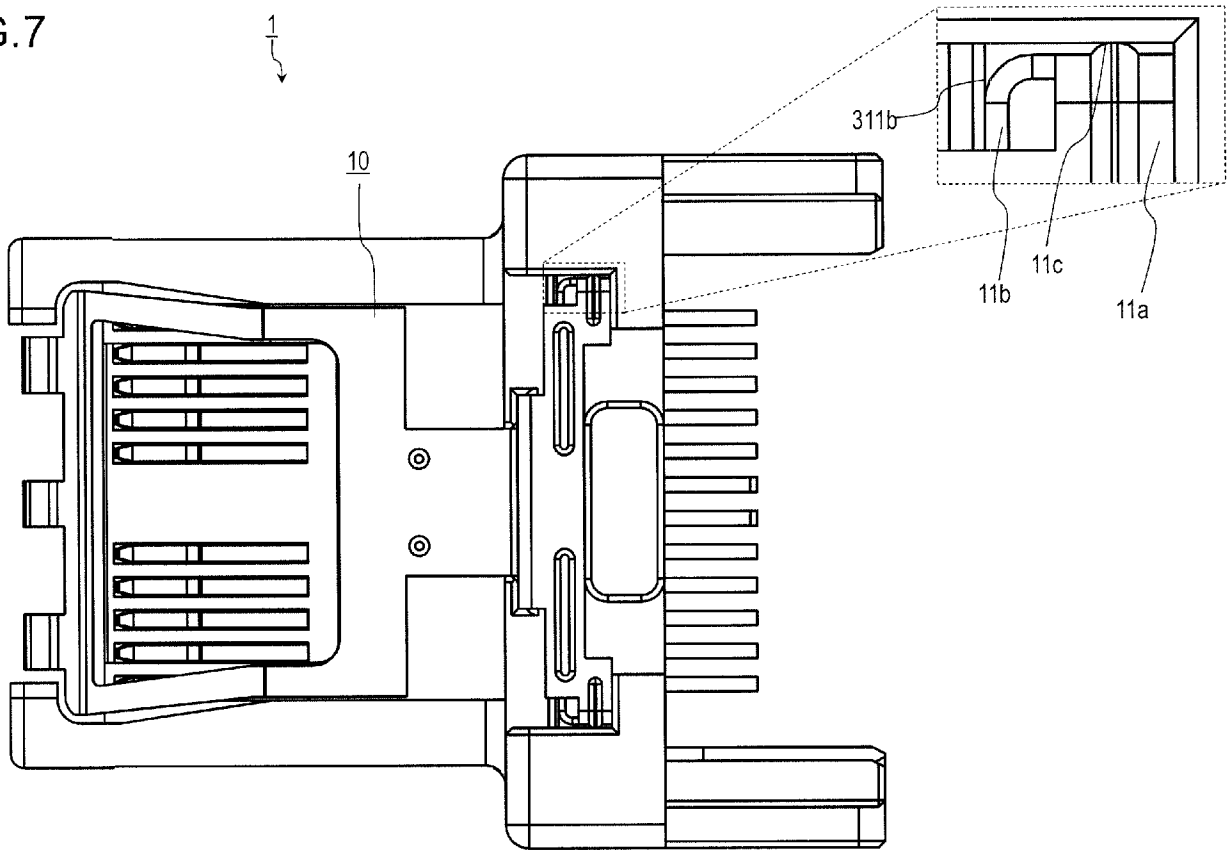
FIG. 7 is a plan view of the connector according to the first embodiment.
Figure 8:
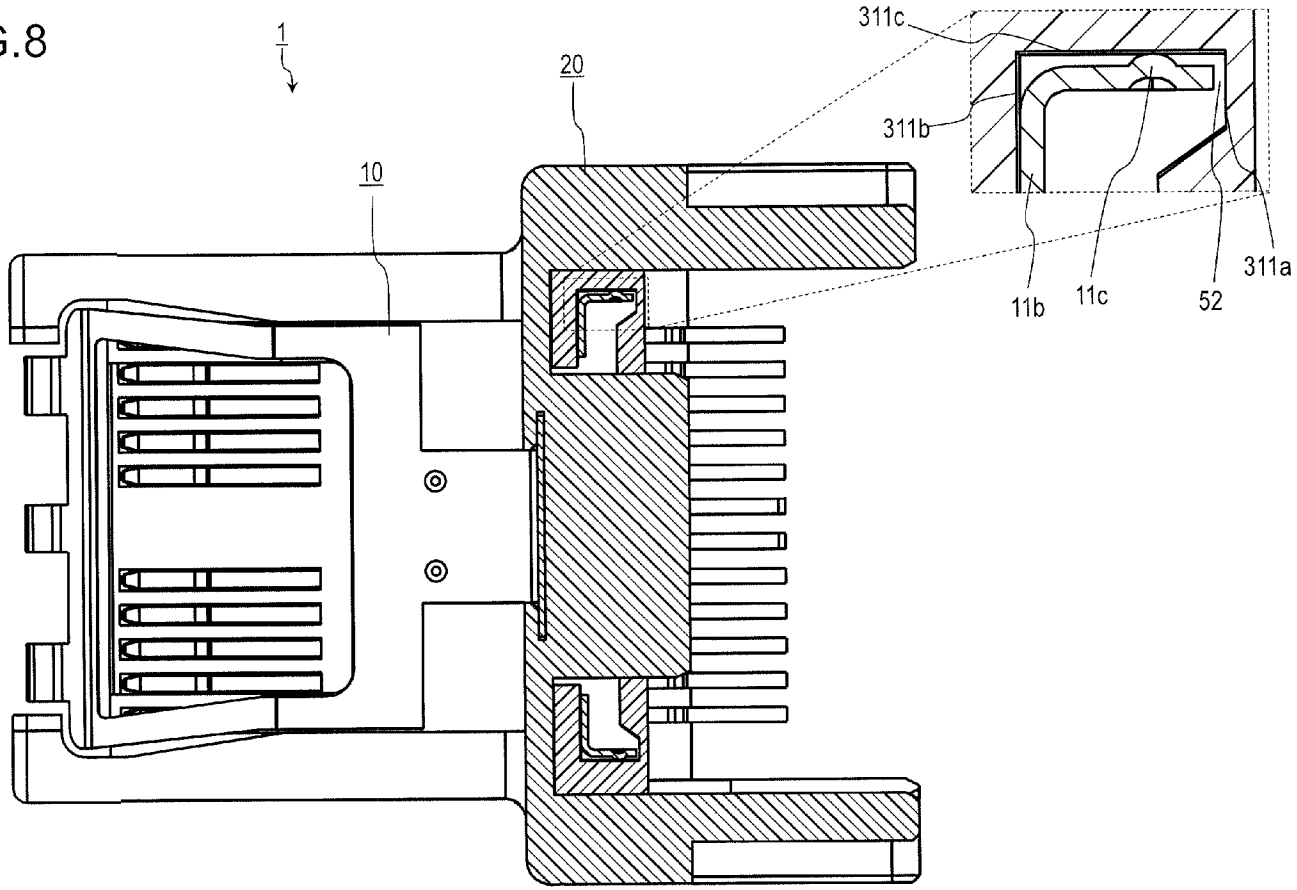
FIG. 8 is a sectional view of the connector according to the first embodiment.
Figure 9:
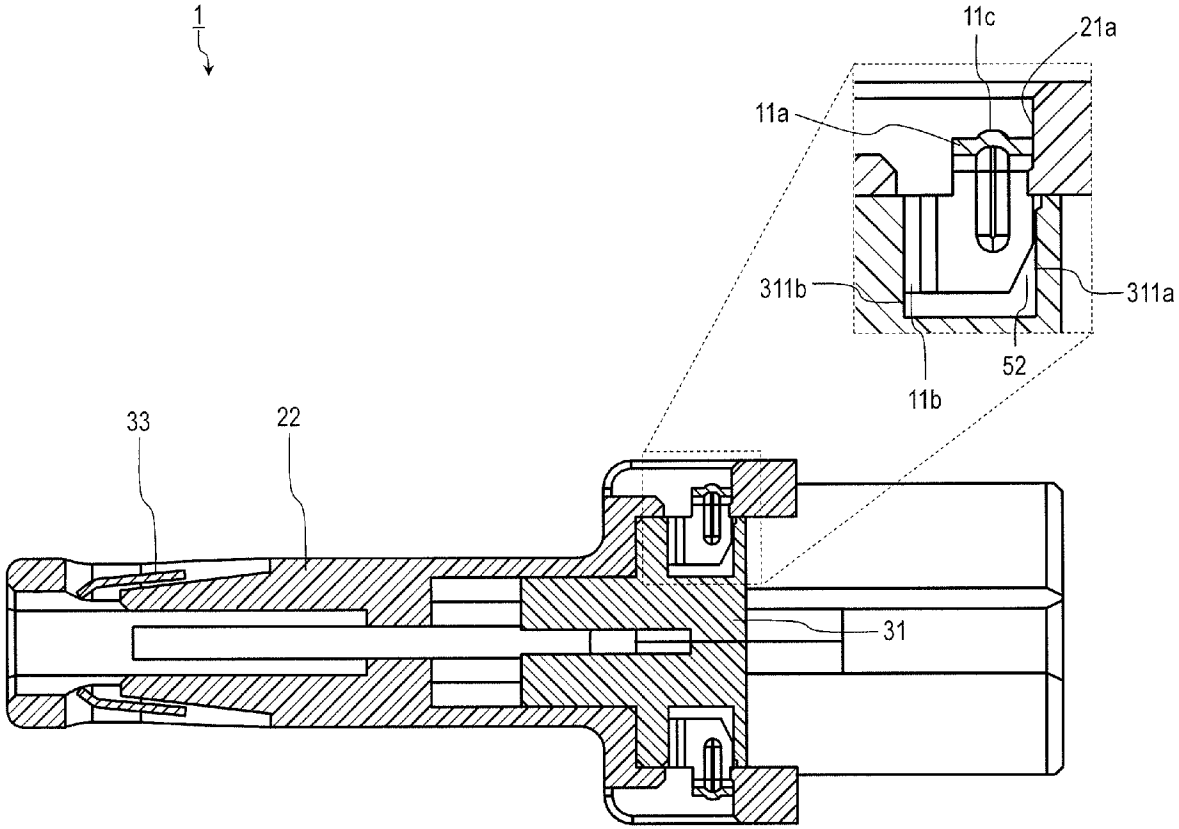
FIG. 9 is a sectional view of the connector according to the first embodiment.
Figure 10:
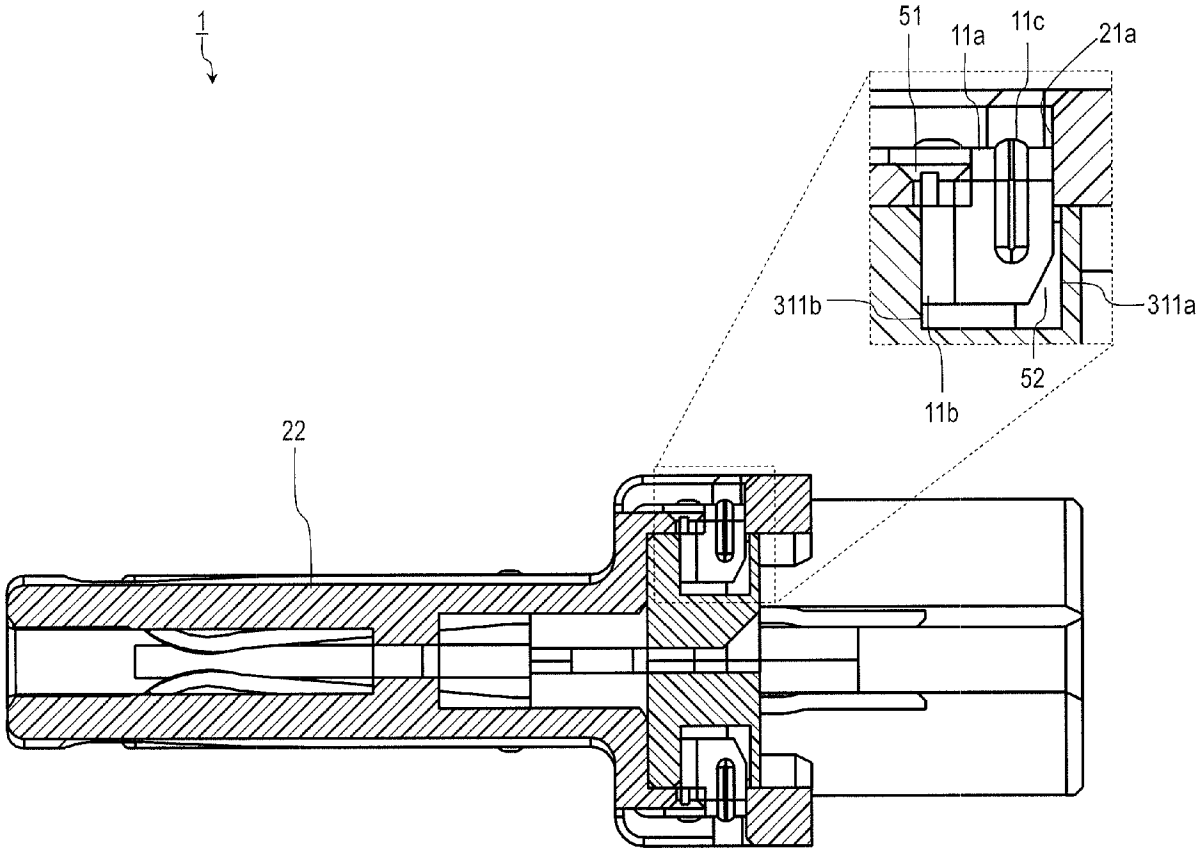
FIG. 10 is a sectional view of the connector according to the first embodiment.

As described above, the contact assembly 30 is accommodated in the housing 20 and the upper and lower metal pieces 10, which make a pair, are coupled from the upper direction and the lower direction of the housing 20 respectively so as to form the connector 1 illustrated in FIG. 5. FIG. 5 is a perspective view of the connector 1 according to the present embodiment. A relation among the arm portion 11, the hole 21*d*, and the recess 311 is described in detail below with reference to FIGS. 6 to 10. FIG. 6 is a front elevational view including indicating lines of sections of the connector 1 according to the present embodiment. FIG. 7 is a plan view of the connector 1 according to the present embodiment. FIGS. 8 to 10 are sectional views which respectively correspond to section indicating lines which are respectively given reference numerals 8, 9, and 10 in FIG. 6.

As illustrated in FIG. 7 and FIG. 8, the pressing portion 11*b* of the metal piece 10 is protruded from the hole 21*d* of the housing 20 toward the inner cavity of the housing 20 when the metal piece 10 is connected to the housing 20 and the body 31. At this time, a tip of the dowel 11*b*-1 of the pressing portion 11*b* is brought into contact only with the second lateral wall 311*b* of the recess 311 of the body 31. Here, the dowel 11*b*-1 is a minute part, so that showing of the dowel 11*b*-1 is omitted in FIGS. 7 to 10. Further, as illustrated in FIG. 8, the third lateral wall 311*c* is brought into contact with the convex portion 11*c*. Further, the end surface, in the connector pulling-out direction, of the L-shaped portion 11*a* (rear end surface) is not directly brought into contact with the first lateral wall 311*a* but faces the first lateral wall 311*a* with a gap 52 interposed therebetween.

As illustrated in FIG. 9 and FIG. 10, the end surface (rear end surface), in the connector pulling-out direction, of the L-shaped portion 11*a* of the metal piece 10 is brought into contact only with the first lateral wall 21*a* of the concave portion 21 of the housing 20 when the metal piece 10 is connected with the housing 20. As illustrated in FIG. 10, the pressing portion 11*b* of the arm portion 11 is not directly brought into contact with the end surface (rear end surface), in the connector pulling-out direction, of the hole 21*d*, but faces the end surface of the hole 21*d* with a gap 51 interposed therebetween.

The rear end surface of the L-shaped portion 11*a* has high rigidity with respect to a force of a direction in which this surface is pressed, and is hardly deformed. This is because the rear end surface of the L-shaped portion 11*a* corresponds to an edge portion (thickness) including a bending portion of a bent metal plate. As mentioned above, the first lateral wall 21*a* of the housing 20 is brought into contact with the rear end surface of the L-shaped portion 11*a* having high rigidity, so that the metal piece 10 and the housing 20 are positioned properly. On the other hand, the rear end surface of the L-shaped portion 11*a* is not directly brought into contact with the first lateral wall 311*a* of the body 31, so that the rear end surface of the L-shaped portion 11*a* does not damage the body 31. The notch 11*d* described above is provided so that the arm portion 11 is easily inserted while avoiding contact between the rear end surface of the L-shaped portion 11*a* and the first lateral wall 311*a* of the body 31.

On the other hand, the pressing portion 11*b* of the metal piece 10 can elastically deform to a small extent in the connector inserting/pulling-out direction. Therefore, when the metal piece 10 is fitted in the housing 20 and the body 31, the pressing portion 11*b* presses the body 31 slightly forward (connector inserting direction) by an elastic force thereof. The pressing portion 11*b* of the metal piece 10 is formed to have some flexibility, so that the contact assembly 30 can be positioned in such a manner that the whole of the contact assembly 30 is gently pressed forward without damaging the body 31. Even though the lateral wall and the like of the recess 311 described above have the thin configurations, these portions can be prevented from being damaged. Therefore, the body 31 can be reduced in size and weight. Accordingly, the whole of the connector 1 can be reduced in size and weight.

Further, the dowel 11*b*-1 is formed near the center of the pressing portion 11*b*, so that the contact assembly 30 is properly positioned with reference to the tip (pointed end) of the dowel 11*b*-1. Accordingly, even if the contact assembly 30 is accommodated in a manner to be slightly shifted in the connector pulling-out direction, the insertion of the lower end of the pressing portion 11*b* is not prevented. When the dowel 11*b*-1 is formed to have a hemisphere shape or a gentle convex surface, the dowel 11*b*-1 gently presses the second lateral wall 311*b* along with the insertion of the arm portion 11. Thus, a load on the second lateral wall 311*b* which is a thin portion of the body 31 can be reduced.

Further, six pieces, in total, of contact pieces 14*a* of the contact portion 14 of the upper and lower metal pieces 10 have shapes necessary for contact with a metal plate of a counterpart connector in USB-Type C standard. Therefore, the metal piece 10 can be said to be an essential constituent part. Thus, the part positioning function is imparted to the metal piece 10 which is an essential part, being able to reduce the number of parts of a connector and contributing to reduce the size of the connector and man-hours in connector manufacturing.

The foregoing description of the embodiments of the invention has been presented for the purpose of illustration and description. It is not intended to be exhaustive and to limit the invention to the precise form disclosed. Modifications or variations are possible in light of the above teaching. The embodiment was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A connector comprising:

a metal piece;

a contact assembly including a body which fixes a plurality of contacts; and a housing in which the contact assembly is inserted in a connector inserting direction to be accommodated; wherein the housing includes a concave portion which has a lateral wall which is opposed to a connector pulling-out direction, and a hole which is formed on a bottom surface of the concave portion, the body includes a recess which has a lateral wall which is opposed to the connector inserting direction, and the metal piece includes an arm portion which is extended in an arrangement direction of the contacts, an L-shaped portion which is formed in a manner to be bent in a direction orthogonal to both of an extending direction of the arm portion and the connector inserting direction, and of which an end surface, in the connector pulling-out direction, is brought into contact only with the lateral wall of the concave portion of the housing in a case of connection with the housing, and a pressing portion which is formed by extending an end surface, in the connector inserting direction, of the L-shaped portion in a forward direction or an inverse direction of the extending direction of the arm portion, and the pressing portion protrudes from the hole to be brought into contact only with the lateral wall of the recess of the body in a case of connection with the housing and the body.

2. The connector according to claim 1, wherein
a dowel which is brought into contact only with the lateral wall of the recess of the body is provided on a surface, the surface being opposed to the connector pulling-out direction, of the pressing portion.

3. The connector according to claim 1, wherein
a notch is provided on a lower portion of the end surface, in the connector pulling-out direction, of the L-shaped portion.

4. The connector according to claim 2, wherein
a notch is provided on a lower portion of the end surface, in the connector pulling-out direction, of the L-shaped portion.

5. The connector according to claim 1, wherein
the metal piece includes a contact portion which is brought into contact with a metal plate of a counterpart connector in coupling with the counterpart connector.

6. The connector according to claim 2, wherein
the metal piece includes a contact portion which is brought into contact with a metal plate of a counterpart connector in coupling with the counterpart connector.

7. The connector according to claim 3, wherein
the metal piece includes a contact portion which is brought into contact with a metal plate of a counterpart connector in coupling with the counterpart connector.

8. The connector according to claim 4, wherein
the metal piece includes a contact portion which is brought into contact with a metal plate of a counterpart connector in coupling with the counterpart connector.

* * * * *